US010442507B2

(12) United States Patent
Kamal et al.

(10) Patent No.: US 10,442,507 B2
(45) Date of Patent: Oct. 15, 2019

(54) BUOYANT OFFSHORE STRUCTURE

(71) Applicant: SHELL OIL COMPANY, Houston, TX (US)

(72) Inventors: Rajiv Kamal, Katy, TX (US); Gregory Wolfgang Alford, Tylertown, MS (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/063,346

(22) PCT Filed: Dec. 15, 2016

(86) PCT No.: PCT/US2016/066787
§ 371 (c)(1),
(2) Date: Jun. 18, 2018

(87) PCT Pub. No.: WO2017/112505
PCT Pub. Date: Jun. 29, 2017

(65) Prior Publication Data

US 2019/0009868 A1 Jan. 10, 2019

Related U.S. Application Data

(60) Provisional application No. 62/270,645, filed on Dec. 22, 2015.

(51) Int. Cl.
*B63B 35/44* (2006.01)
*B63B 22/24* (2006.01)
(Continued)

(52) U.S. Cl.
CPC ..... *B63B 35/44* (2013.01); *B63B 22/24* (2013.01); *B63J 4/00* (2013.01); *B65D 88/08* (2013.01); *B65D 90/041* (2013.01); *B65D 90/66* (2013.01); *B63B 2035/4486* (2013.01); *B63B 2701/02* (2013.01)

(58) Field of Classification Search
CPC ..... B63B 35/44; B63B 22/24
See application file for complete search history.

(56) References Cited

U.S. PATENT DOCUMENTS 3,576,257 A * 4/1971 Yates ..... B01D 17/0214 210/242.3
4,864,958 A * 9/1989 Belinsky ..... B63B 1/107 114/265

(Continued)

FOREIGN PATENT DOCUMENTS

GB 2523717 A * 9/2015 ..... E02B 17/025
GB 2523717 A 9/2015
WO 2010042937 A2 4/2010

OTHER PUBLICATIONS

International Search Report and Written Opinion received for PCT Patent Application No. PCT/US2016/066787, dated Aug. 18, 2017, 9 pages.

*Primary Examiner* — S. Joseph Morano
*Assistant Examiner* — Jovon E Hayes

(57) ABSTRACT

A buoyant offshore structure, comprising a hull element (6*a*) having an inner space (10), a surface end (12) and an underwater end (14); and at least one storage tank (15*a*) for liquid, extending from the surface end (12) of the hull element into the inner space (10), wherein the storage tank is removable from the inner space by lifting from the hull element's surface end.

9 Claims, 4 Drawing Sheets

Figure 1:
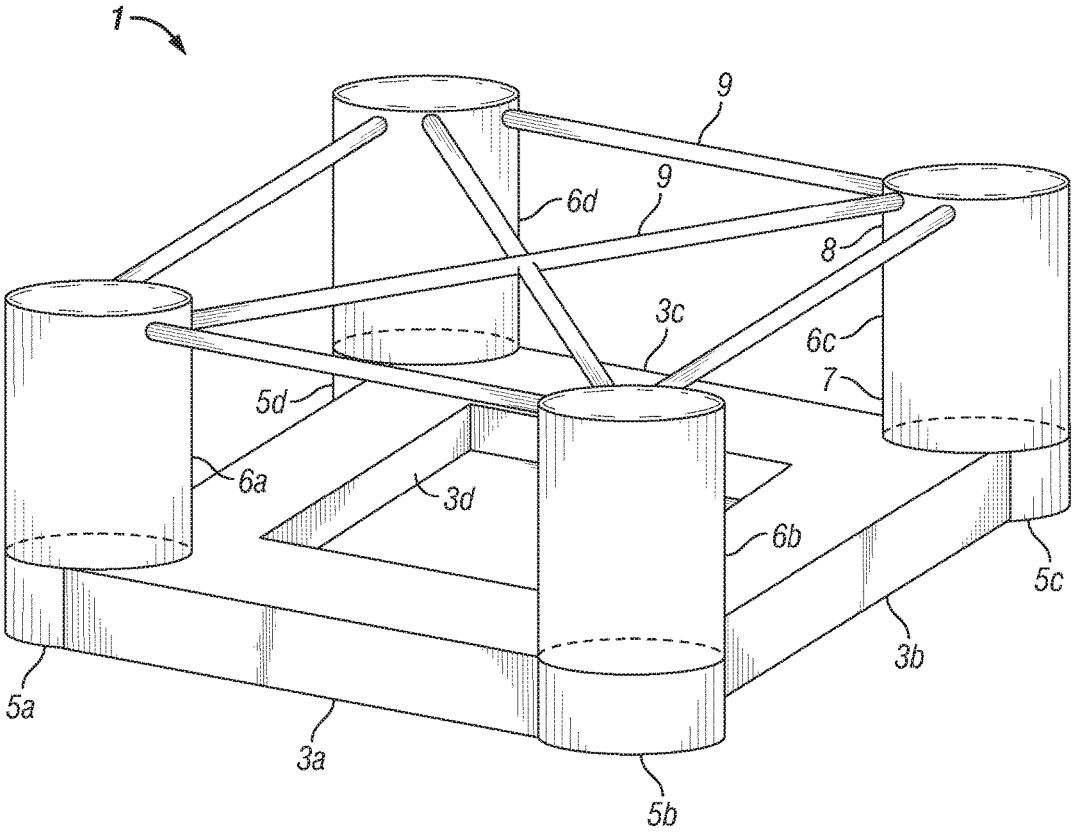

(51) Int. Cl.

| | |
|---|---|
| ***B63J 4/00*** | (2006.01) |
| ***B65D 88/08*** | (2006.01) |
| ***B65D 90/04*** | (2006.01) |
| ***B65D 90/66*** | (2006.01) |

(56) References Cited

U.S. PATENT DOCUMENTS

| | | | | |
|---|---|---|---|---|
| 8,387,550 | B2 * | 3/2013 | Mansour | B63B 39/00 114/125 |
| 8,757,081 | B2 * | 6/2014 | Xu | B63B 1/107 114/265 |
| 8,807,062 | B2 * | 8/2014 | Tahar | B63B 35/4413 114/125 |
| 2015/0041142 | A1 * | 2/2015 | Wang | B63B 35/44 166/335 |
| 2019/0009868 | A1 * | 1/2019 | Kamal | B63B 22/24 |

* cited by examiner

BUOYANT OFFSHORE STRUCTURE

PRIORITY CLAIM

The present application is the National Stage (§ 371) of International Application No. PCT/US2016/066787, filed Dec. 15, 2016, which claims priority from U.S. Application No. 62/270,645, filed Dec. 22, 2015, incorporated herein by reference.

CROSS REFERENCE TO RELATED APPLICATIONS

This application claims the benefit of U.S. Provisional Application No. 62/270,645, filed Dec. 22, 2015, which is incorporated herein by reference.

FIELD OF THE INVENTION

The present invention relates to a buoyant offshore structure, such as an offshore platform or spar.

BACKGROUND OF THE INVENTION

Typical offshore structures such as semi-submersible or tension-leg platforms, or a spar, comprise a hull part that extends into the water, and which has sufficient buoyancy to support a work area or platform above the water surface. The hull of a platform typically comprises a structure of a plurality of horizontal pontoon elements connected by nodes, which supports a plurality of column elements vertically upstanding from the nodes, which column elements in turn support the work platform or topside above the surface of the water. In general, the size and configuration of the pontoons and the size, number and shape of columns are governed by the size and weight of the work platform and associated payload to be supported. Such a platform is for example disclosed in International patent application publication No. WO 2010/042937.

During operation of an offshore platform it can be needed to store chemicals in substantial quantities, such as for use during a drilling operation, for a treatment of the subsea formation, or for enhanced oil recovery. Certain such chemicals can be corrosive. Over the service life of such platform of typically many years, different chemicals may need to be stored.

There is a need in the art for an improved storage for liquid on a buoyant offshore structure.

SUMMARY OF THE INVENTION

In accordance with the invention there is provided a buoyant offshore structure, comprising

- a hull element having an inner space, a surface end and an underwater end; and
- at least one storage tank for liquid, extending from the surface end of the hull element into the inner space, wherein the storage tank is removable from the inner space by lifting from the hull element's surface end.

DETAILED DESCRIPTION OF THE INVENTION

By providing a storage tank that is vertically supported from the surface end of the hull element and can be lifted, such tank can be easily replaced should that be needed during the service life of the offshore structure, e.g. in case of corrosion.

In some embodiments, the buoyant offshore structure comprises a plurality of storage tanks for liquid. Each of these tanks can be arranged such that it is separately removable by lifting from the hull element's surface end. Providing more storage tanks enables storing of a greater volume and/or different types of liquids or chemicals.

In some embodiments the hull element comprises a sump tank and the at least one storage tank is at least partially arranged in the sump tank. In particular, a plurality, such as two or more storage tanks, can be at least partially arranged in the sump tank.

In some embodiments the hull element can be substantially column-shaped, such as substantially cylindrical.

In some embodiments the sump tank can be substantially column-shaped, such as substantially cylindrical.

In some embodiments the storage tank can be substantially column-shaped, such as substantially cylindrical.

In some embodiments the buoyant offshore structure comprises additional hull elements with an inner space, a surface end and an underwater end. The additional hull elements can also be substantially column shaped, such as substantially cylindrical.

In some embodiments, two or more of the hull elements can each comprise one or more storage tanks, such as two or more storage tanks.

In some embodiments, two or more of the hull elements can each comprise one or more sump tanks, wherein at least one of the sump tanks comprises a liquid storage tank.

In some embodiments, the at least one storage tank is laterally supported between the surface end and the underwater end. In embodiments wherein the storage tank is arranged in a sump tank, the storage tank can suitably be laterally supported at one or more locations in the sump tank, such as at different heights. In some embodiments a plurality of storage tanks is provided which are laterally supported between the surface end and the underwater end. In some embodiments the lateral support of one storage tank or a plurality of storage tanks can provided within a sump tank.

In some embodiments, the buoyant offshore structure comprises a corrosion-resistant metal at an inner surface. In particular, the corrosion resistant metal can be more corrosion resistant than carbon-steel. The corrosion resistant metal can be stainless steel or super duplex steel.

In some embodiments, the at least one storage tank suspended in the hull is accessible from the surface end of the hull element for at least one of: introducing liquid into the storage tank, removing liquid from the storage tank, placing, removing or servicing a pump in the storage tank. Such pump can be a submersible pump that can be installed and is accessible from the top of the storage tank (surface end of the hull element).

In some embodiments the top of the tank is accessible by a crane.

Figure 2:
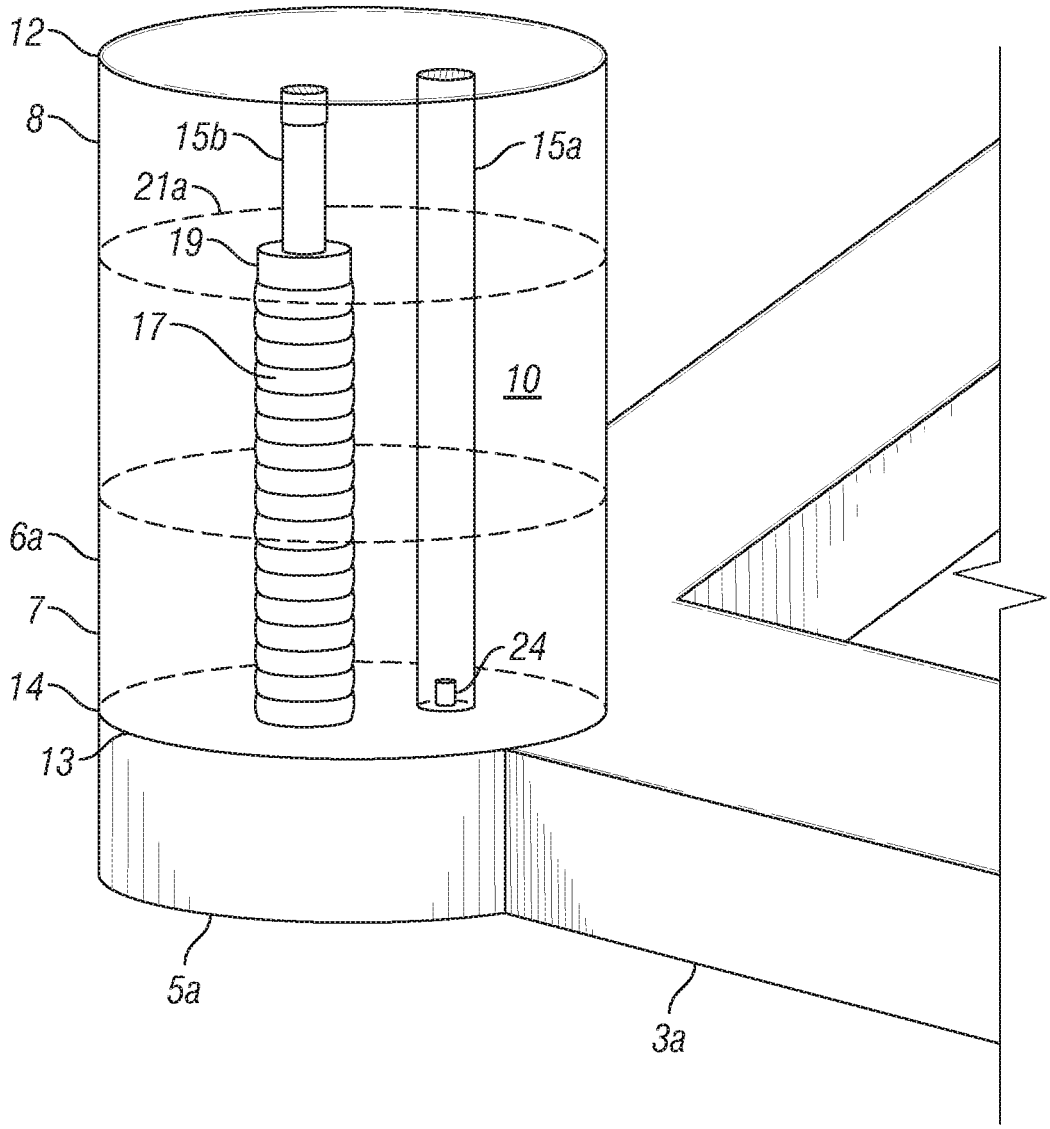
Figure 3:
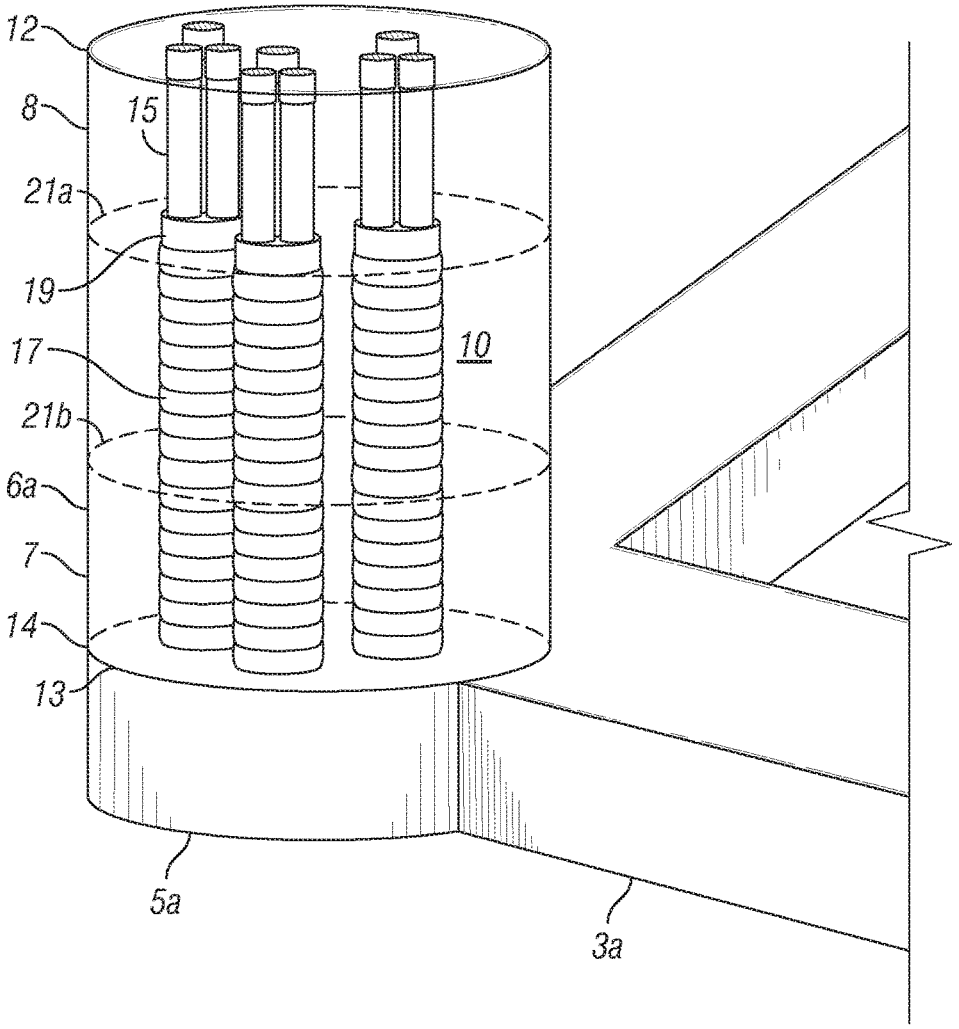
Figure 4:
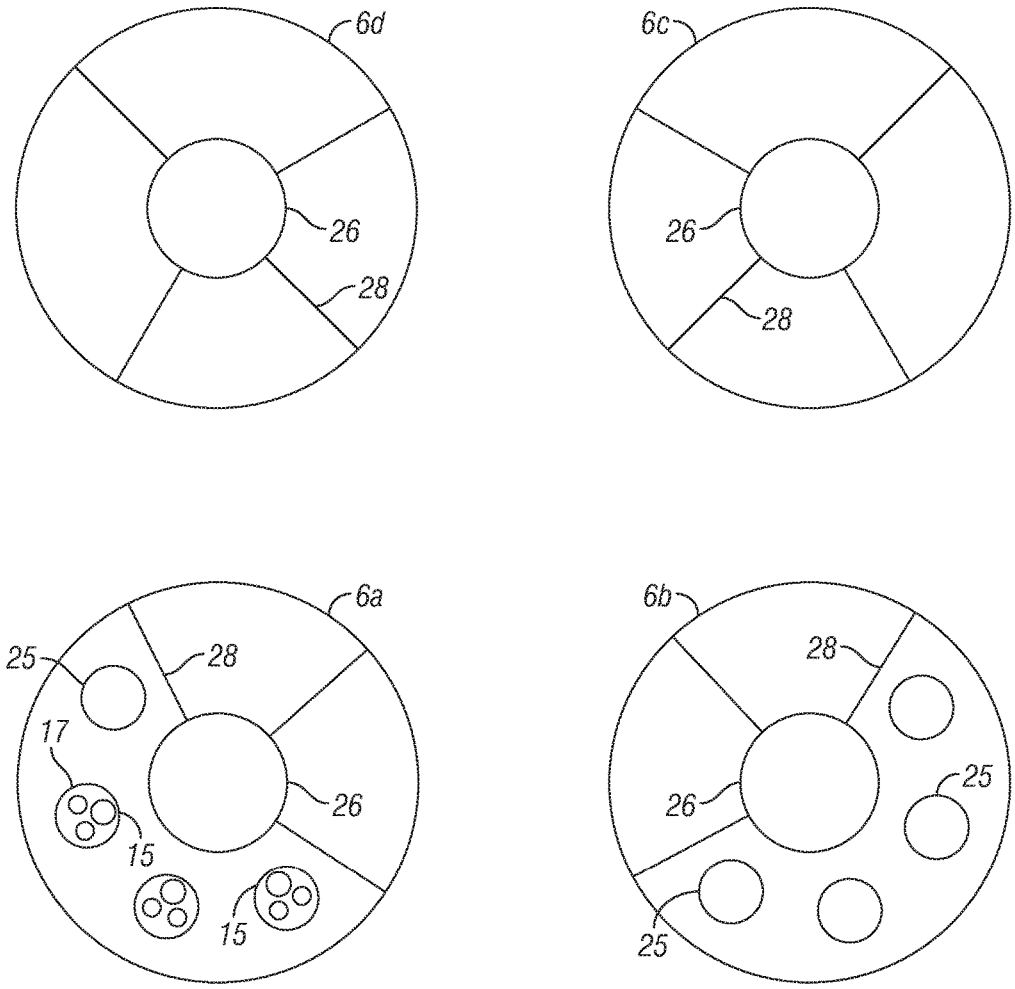

The invention shall now be further described by way of example and with reference to the drawings, wherein FIG. 1 schematically shows a buoyant offshore structure;

FIG. 2 schematically shows an embodiment of a hull element of the structure shown in FIG. 1;

FIG. 3 schematically shows another embodiment of a hull element of the structure shown in FIG. 1;

FIG. 4 schematically shows an embodiment of a horizontal cross-section through the structure shown in FIG. 1.

Where like reference numerals are used in the Figures, they refer to the same or similar elements when they carry the same number.

Reference is made to FIG. 1, which schematically shows a semi-submersible offshore platform 1. This structure 1 comprises pontoons 3*a,b,c,d* interconnected by nodes 5*a,b,c,d,* together forming a substantially rectangular frame that is part of the offshore structure's hull. The rectangular frame can have side lengths in the range of from 25 to 150 m, suitably from 50 to 100 m. The rectangular frame can have a height in the range of from 1 to 100 m, suitably from 2 to 25 m. Hull elements 6*a,d,b,d* are provided at the nodes. The upright hull elements in this embodiment are each substantially column-shaped, and will also be referred to as columns hereinafter. The columns can be in the range of from 5 to 300 m high, suitably from 30 to 75 m. The diameter of the columns can be in the range of from 3 to 50 m, suitably from 5 to 40 m. The columns of this embodiment are interconnected at their top by beams 9. The frame thus formed can for example be used for mounting a topside (not shown) of the platform 1, with drilling and/or production equipment, quarters, etc. The volume of hollow spaces on pontoons, nodes and hull elements (columns) is selected such that the offshore platform 1 is buoyant in water (not shown), wherein the pontoons, nodes and lower parts 7 of the columns are below the waterline and the upper part 8 of the columns is above the waterline in normal floating operation, with or without tension applied towards the bottom of the sea.

Reference is made to FIG. 2, which shows schematically a first exemplary embodiment of hull element 6*a* from FIG. 1 in more detail, in particular elements in its inner space 10. Column 6*a* has a surface end 12 and an underwater end 14, which can be at the top 13 of the node 5*a*. A storage tank 15*a* extends from the surface end 12 downwardly to a position in the inner space 10. In some embodiments that position can be at or near the underwater end 14, such as within 10 meters from the underwater end, or within 5 meters from the underwater end. In some embodiments that position can be higher in the column 5*a*. In some embodiments that position can be in the upper part 8. Liquid can be introduced into and removed from the storage tank through an opening that is suitably arranged at the surface end 12. The diameter of a storage tank can be in the range of from 0.5 to 10 m, such as from 1 to 5 m. A storage tank can for example be used for storing chemicals, e.g. methanol, scale inhibitors, corrosion inhibitors, or crude oil based liquids, e.g. diesel.

FIG. 2 shows a further storage tank 15*b,* which is partially arranged in a sump tank 17. Storage tank 15*b* sizes, dimensions and lower end position can be as specified for storage tank 15*a*. The sump tank 17 in this embodiment extends upwardly from a position in the inner space 10. In some embodiments that position can be at or near the underwater end 14 of the column 5*a,* such as within 10 m, or within 5 m from the underwater end. In some embodiments that position can be higher in the column 5*a*. The sump tank has an upper end 19 in the upper part 8 of the column. The upper end can be below the surface end 12 as shown in FIG. 2, but it shall be understood that it can also extend to the surface end 12. The diameter of a sump tank can be in the range of from 2 to 15 m, such as from 3 to 10 m. The sump tank provides a natural subdivision of hull space. It is can be supported by flats, such as flats 21*a* and 21*b*. A flat is any structural stiffened plating that is horizontal in nature. In some embodiments the flats can be watertight flats, compartmentalizing the hull into vertically separate voids, such that water cannot flow from one void to the other if for example there is water ingress through a leak in the hull. A watertight flat seals against the sump tank(s), or the storage tank(s), respectively.

Compartmentalization is preferred in order to prevent sinking of the structure in case of a leak due to e.g. an accident such as boat impact, corrosion, or another form of damage. Providing a sump tank, or a plurality of sump tanks, provides additional compartmentalization.

In some embodiments, the storage tank is laterally supported within the sump tank, at one or more locations between the surface end and the underwater end, such as at vertically separate locations. Preferably, lateral supports are releasably or removably arranged. Lateral supports can for example be provided by bolted connections, and they can be unbolted if the removal of the storage tank is needed. The lateral supports can be arranged such that they can be installed, in particular removably installed, from the surface end of the column. In some embodiments support can be provided by a person descending into the hull and unbolting the storage tank before it is lifted up by a crane.

The exemplary embodiment of FIG. 2 shows two types of storage tanks 15*a* and 15*b,* to illustrate storage tanks of the types that are arranged or not in a sump tank. It shall be understood that in some embodiments only one of these types may be present, and that a plurality of such storage tanks and optionally sump tanks can be arranged.

Reference is made to FIG. 3, which shows schematically another embodiment of hull element 6*a* from FIG. 1 in more detail. A plurality of storage tanks 15 extend from the surface end 12 to a position at or near the underwater end 14, each substantially as described with reference to FIG. 2. In the embodiment as shown in FIG. 3, nine storage tanks are shown, in three groups of three, wherein each group consists of two substantially cylindrical storage tanks of a first diameter, and a third storage tank of a second diameter that is larger than the first diameter. It shall be clear that many other configurations are possible, and that more or less sump tanks can be provided. In some embodiments, at least two storage tanks are provided. In some embodiments, the storage tanks have substantially the same diameter.

In the embodiment shown in this example, the hull element comprises three sump tanks 17, each substantially as described with reference to FIG. 2, but it will be understood that more or less sump tanks can be provided. The storage tanks 15 are partially arranged in the sump tank. Each of said groups of three storage tanks extends from the surface end 12 of the column 5*a* downwardly into one of the sump tanks 17. This enables storage of large quantities of many different chemicals or other liquids.

The storage tank or tanks in the embodiments referred to herein suitably comprise a corrosion-resistant metal at an inner surface, that is more corrosion resistant than carbon-steel, for example stainless steel or super duplex steel. In some embodiments the tank can have an inner cladding of such metal, or in some other embodiments it can be integrally formed of such metal.

In a storage tank a pump 24 can be arranged, such as an electrical submersible pump. This is only visible in FIG. 2 for storage tank 15*a,* but it will be understood that such pump can also be arranged in the storage tank 15*b*. The pump is suitably arranged accessible from the surface end 12 of the storage tank, in particular it is suitably removable through the surface end, so that it can be easily replaced if that is desired.

The columns, storage tanks, sump tanks in the embodiments as shown in the drawings are all substantially cylindrical. It shall be understood that they can have different shapes and lengths, e.g. different cross-sectional shapes such as polygonal, and/or changing cross-sectional shape or diameter along their vertical length. More than one upright hull element can be arranged per node.

Storage tanks are suitably arranged such that they can be inserted from the top 12 of the column. Suitably they are hung off from the top of the column Suitably they can also be retrieved by lifting from the surface end or top of the column, such as using a crane or other lifting device. This enables servicing and removing or replacing any of the storage bullet tanks throughout the life of the offshore structure. Suitably lateral supports are released or removed before lifting. In some embodiments, all storage tanks are removable by lifting from the surface end. In some embodiments, only part of the storage tanks are removable by lifting, for example only storage tanks that are arranged in a sump tank.

Reference is made to FIG. 4, showing schematically a horizontal cross-section through an offshore structure as in FIG. 1, substantially at the vertical height of the waterline during normal operation. The embodiment shown in this figure illustrates that the columns can have different arrangement internally. Column 6*a* in this Figure is substantially as described with reference to FIG. 2, with the addition of a storage tank 25*a* similar to storage tank 15*a* shown in FIG. 2. Column 6*b* has four of such storage tanks 25. On columns 6*c* and 6*d* no storage tanks are provided.

Reference numeral 26 in each column indicates a conventional access shaft of the column.

Each of the columns is divided in compartments by suitable vertical walls 28, which can also be referred to as bulkheads, which are suitably water-tight. As can be seen, the columns 6*c* and 6*d* that do not have storage tanks are subdivided into vertical compartments by walls 28. The compartmentalization by vertical walls superimposes the compartmentalization by horizontal flats as discussed hereinabove, so that a plurality of smaller compartments is formed. Columns 6*a* and 6*b* that have storage tanks in accordance with the present invention have only 3 vertical walls 28, but nevertheless can achieve sufficient compartmentalization by virtue of the sump tanks 15 and/or storage tanks 25. The additional steel and therefore weight which is installed for sump tanks and storage tanks, is at least partially compensated by a lower number of vertical walls.

In the embodiments discussed hereinabove the invention has been described at the hand of a semi-submersible platform, but it shall be understood that it can be applied as well in other buoyant offshore structures, for example a tension-leg platform, or a spar.

The person skilled in the art will readily understand that, while the invention is illustrated making reference to one or more specific combinations of features and measures, many of those features and measures are functionally independent from other features and measures such that they can be equally or similarly applied independently or in combination in other embodiments of the invention.

That which is claimed is:

1. A buoyant offshore structure, comprising a hull element having an inner space, a surface end and an underwater end, wherein the hull element comprises a sump tank; and at least one storage tank for liquid, wherein the at least one storage tank is at least partially arranged in the sump tank and extends from the surface end of the hull element into the inner space, wherein the storage tank is removable from the inner space by lifting from the hull element's surface end.

2. The buoyant offshore structure according to claim 1, comprising a plurality of storage tanks for liquid.

3. The buoyant offshore structure according to claim 1, wherein a plurality of storage tanks is at least partially arranged in the sump tank.

4. The buoyant offshore structure according to claim 1, comprising a plurality of sump tanks.

5. The buoyant offshore structure according to claim 1, wherein the floating offshore structure comprises additional hull elements having an inner space, a surface end and an underwater end.

6. The buoyant offshore structure according to claim 1, wherein the at least one storage tank is laterally supported between the surface end and the underwater end.

7. The buoyant offshore structure according to claim 1, comprising a plurality of storage tanks which are laterally supported between the surface end and the underwater end.

8. The buoyant offshore structure according to claim 1, wherein the at least one storage tank is laterally supported in the sump tank.

9. The buoyant offshore structure according to claim 1, wherein the at least one storage tank comprises a corrosion-resistant metal at an inner surface.

* * * * *